US010188896B2

(12) United States Patent
Namiki

(10) Patent No.: US 10,188,896 B2
(45) Date of Patent: Jan. 29, 2019

(54) EXERCISE ASSISTING DEVICE

(71) Applicant: Toshiki Namiki, Nagano (JP)

(72) Inventor: Toshiki Namiki, Nagano (JP)

( * ) Notice: Subject to any disclaimer, the term of this patent is extended or adjusted under 35 U.S.C. 154(b) by 0 days.

(21) Appl. No.: 15/537,443

(22) PCT Filed: Jul. 7, 2015

(86) PCT No.: PCT/JP2015/069483
§ 371 (c)(1),
(2) Date: Jun. 19, 2017

(87) PCT Pub. No.: WO2016/103770
PCT Pub. Date: Jun. 30, 2016

(65) Prior Publication Data

US 2017/0348558 A1 Dec. 7, 2017

(30) Foreign Application Priority Data

Dec. 25, 2014 (JP) ..... 2014-262386

(51) Int. Cl.

| | |
|---|---|
| ***A63B 21/072*** | (2006.01) |
| ***A63B 23/16*** | (2006.01) |
| ***A63B 69/00*** | (2006.01) |
| ***A63B 21/06*** | (2006.01) |
| *A63B 21/00* | (2006.01) |

(52) U.S. Cl.
CPC ..... *A63B 21/0726* (2013.01); *A63B 21/0604* (2013.01); *A63B 23/16* (2013.01); *A63B 69/0028* (2013.01); *A63B 21/4019* (2015.10); *A63B 21/4039* (2015.10)

(58) Field of Classification Search
CPC . A63B 21/0726; A63B 23/16; A63B 21/0604; A63B 21/4019; A63B 21/4039; A63B 69/0028
See application file for complete search history.

(56) References Cited

U.S. PATENT DOCUMENTS 1,229,658 A * 6/1917 Sandow ..... A63B 21/0726 43/23
3,746,356 A * 7/1973 Shipstad ..... A63C 11/222 2/16
4,004,818 A * 1/1977 Ramillon ..... A63C 11/222 280/821

(Continued)

FOREIGN PATENT DOCUMENTS

JP 3087221 U 7/2002
JP 2004-089578 A 3/2004
JP 2009-279365 A 12/2009

OTHER PUBLICATIONS

Written Opinion issued in PCT/JP2015/069483; dated Sep. 29, 2015.

(Continued)

*Primary Examiner* — Joshua Lee
(74) *Attorney, Agent, or Firm* — Studebaker & Brackett PC

(57) ABSTRACT

This exercise assisting device (1) is provided with a grip member (3) that can be gripped by a hand and that extends in a tubular shape or in a columnar shape. The grip member (3) has a recessed part (31) configured so that, when the device is gripped by the hand, only a portion at which the middle finger is placed is recessed.

10 Claims, 19 Drawing Sheets

(56) References Cited

U.S. PATENT DOCUMENTS 4,105,200 A * 8/1978 Unger ..... A63B 23/16 482/122
4,218,057 A * 8/1980 Wilson ..... A63B 21/0603 482/109
4,351,526 A * 9/1982 Schwartz ..... A63B 21/0726 482/105
4,493,494 A * 1/1985 Feagin, Jr. ..... A63C 11/222 135/76
4,613,156 A * 9/1986 Lajos ..... A63C 11/222 16/421
4,750,760 A * 6/1988 Gurley ..... A63C 11/222 16/DIG. 12
5,003,997 A * 4/1991 Stewart ..... A45D 29/22 128/879
5,076,569 A * 12/1991 Gootter ..... A63B 23/16 482/49
5,135,455 A * 8/1992 King ..... A63B 21/0726 482/105
5,403,008 A * 4/1995 Mainiero ..... A63B 23/16 473/201
5,823,922 A * 10/1998 Eckmann ..... A63B 21/0726 482/105
5,930,835 A * 8/1999 Silvestri ..... A63C 11/00 2/16
7,381,156 B2 * 6/2008 Silagy ..... A63B 21/0004 482/122
8,092,411 B2 * 1/2012 Betcher ..... A61F 5/0118 128/878
D776,210 S * 1/2017 Abdourazak ..... D21/684
2012/0329610 A1 * 12/2012 White ..... A63B 23/16 482/44

OTHER PUBLICATIONS

International Search Report issued in PCT/JP2015/069483; dated Sep. 29, 2015.

* cited by examiner

EXERCISE ASSISTING DEVICE

TECHNICAL FIELD

The present invention relates to an exercise assisting device used in jogging, walking, etc.

BACKGROUND ART

Conventionally, a device has been know that includes a baton-shaped grip having irregularities in the surface, as an exercise assisting device used in jogging (running), walking (walk), etc. (e.g., refer to Patent Document 1). The grip described in Patent Document 1 is formed in a tubular shape that narrows from one end towards the other end. The grip described in Patent Document 1 has irregularities such that match the form of five fingers upon gripping. The grip described in Patent Document 1 is said to enable running with better form, by decreasing balance deviation in the body, by making running in a state gripping the grip having the irregularities.

However, from the past, it has been known that the correct way of swinging of arms influences the way of running and way of walking, in jogging (running), walking (walk), etc. It has been considered possible to realize stable running and walking so long as able to properly swing the arms, and stabilize the way of swinging of arms.

Patent Document 1: Japanese Registered Utility Model No. 3087221

DISCLOSURE OF THE INVENTION

Problems to be Solved by the Invention

However, the exercise assisting device described in Patent Document 1 focuses on the balance deviation of the body, and does not focus on the way of swinging of arms. For this reason, an exercise assisting device has been demanded by which arms can be properly swung upon running or walking, and can stabilize the way of swinging of arms.

The present invention has an object of providing an exercise assisting device that enables proper swinging of arms upon running or walking, and can stabilize the way of swinging of arms.

Means for Solving the Problems

The present invention relates to an exercise assisting device including a gripping member that extends in a tubular shape or columnar shape which can be gripped by hand, in which the gripping member has a recessed part in which only a portion at which a middle finger is disposed upon gripping by hand is recessed.

In addition, forward of the gripping member corresponds to forward of a person, and rearward of the gripping member corresponds to rearward of the person, when gripping the gripping member forward of the person in a state making the gripping member stand up, and it is preferable for the exercise assisting device to further include a first weight member disposed at a lower part on a rearward side of the gripping member.

Moreover, forward of the gripping member corresponds to forward of a person, and rearward of the gripping member corresponds to rearward of the person, when gripping the gripping member forward of the person in a state making the gripping member stand up, and it is preferable for the exercise assisting device to further include a second weight member disposed on a rearward side of the gripping member, and extending in a longitudinal direction of the gripping member.

Furthermore, forward of the gripping member corresponds to forward of a person, rearward of the gripping member corresponds to rearward of the person, and outwards of the gripping member corresponds to either outward in a left/right direction of the person, when gripping the gripping member forward of the person in a state making the gripping member stand up, and it is preferable for the exercise assisting device to further include a third weight member disposed at a lateral part on either outward side of the gripping member, and extending in a longitudinal direction of the gripping member.

In addition, it is preferable to further include a protrusion disposed between a ring finger and a pinky finger when gripping the gripping member.

Moreover, forward of the gripping member corresponds to forward of a person, and rearward of the gripping member corresponds to rearward of the person, when gripping the gripping member forward of the person in a state making the gripping member stand up, and it is preferable for the exercise assisting device to further include a holder disposed on a rearward side of the gripping member, and covering a thumb in a state standing upwards.

Furthermore, it is preferable for the exercise assisting device to further include a fourth weight member disposed on a rearward side of the holder.

Effects of the Invention

According to the present invention, it is possible to provide an exercise assisting device that enables proper swinging of arms upon running or walking, and can stabilize the way of swinging of arms.

PREFERRED MODE FOR CARRYING OUT THE INVENTION

Figure 1:
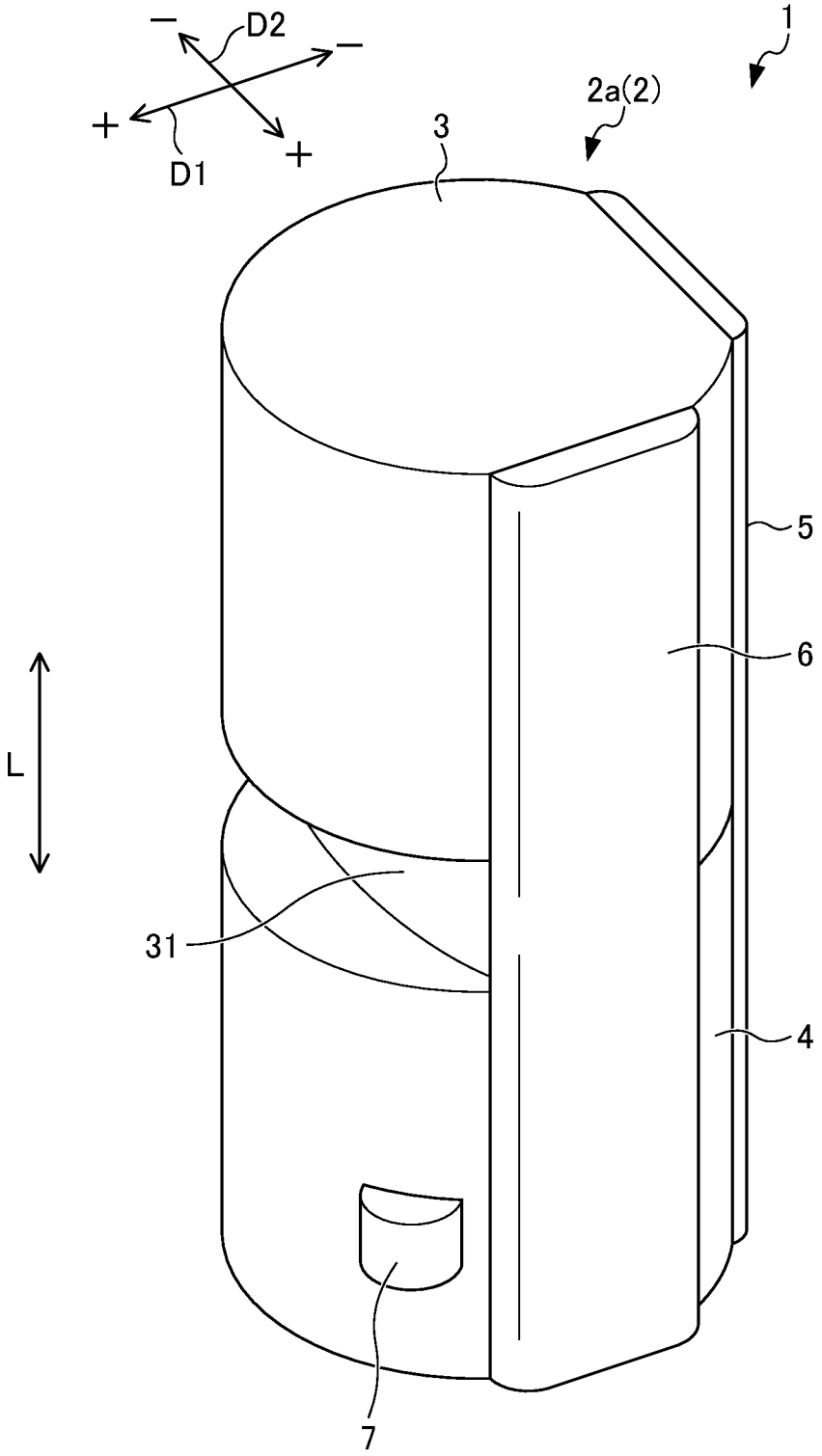
FIG. 1 is a perspective view showing a left-hand grip body 2*a* of an exercise assisting device 1 according to a first embodiment of the present invention.
Figure 2:
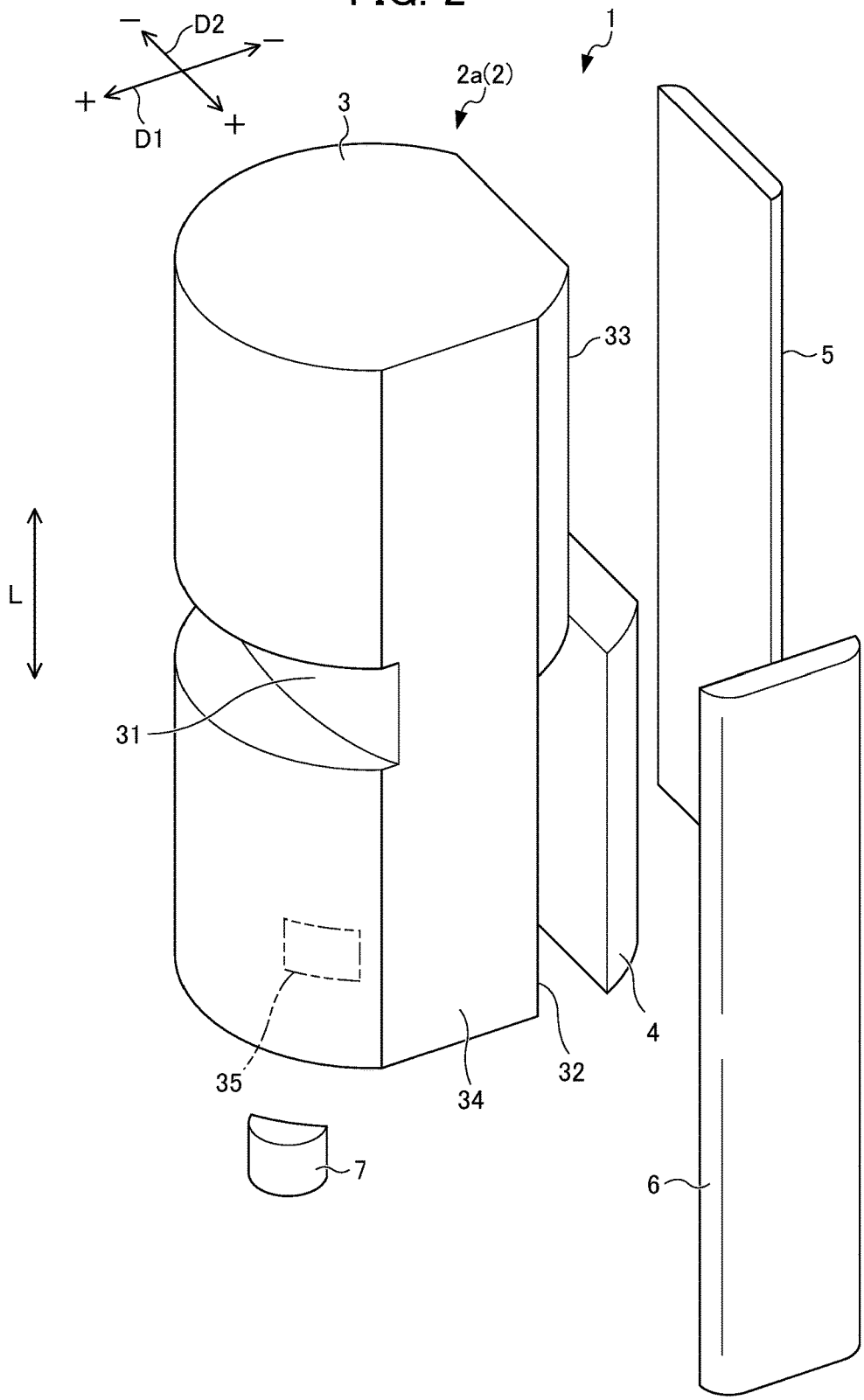
FIG. 2 is an exploded perspective view of the grip body 2*a;*
Figure 3:
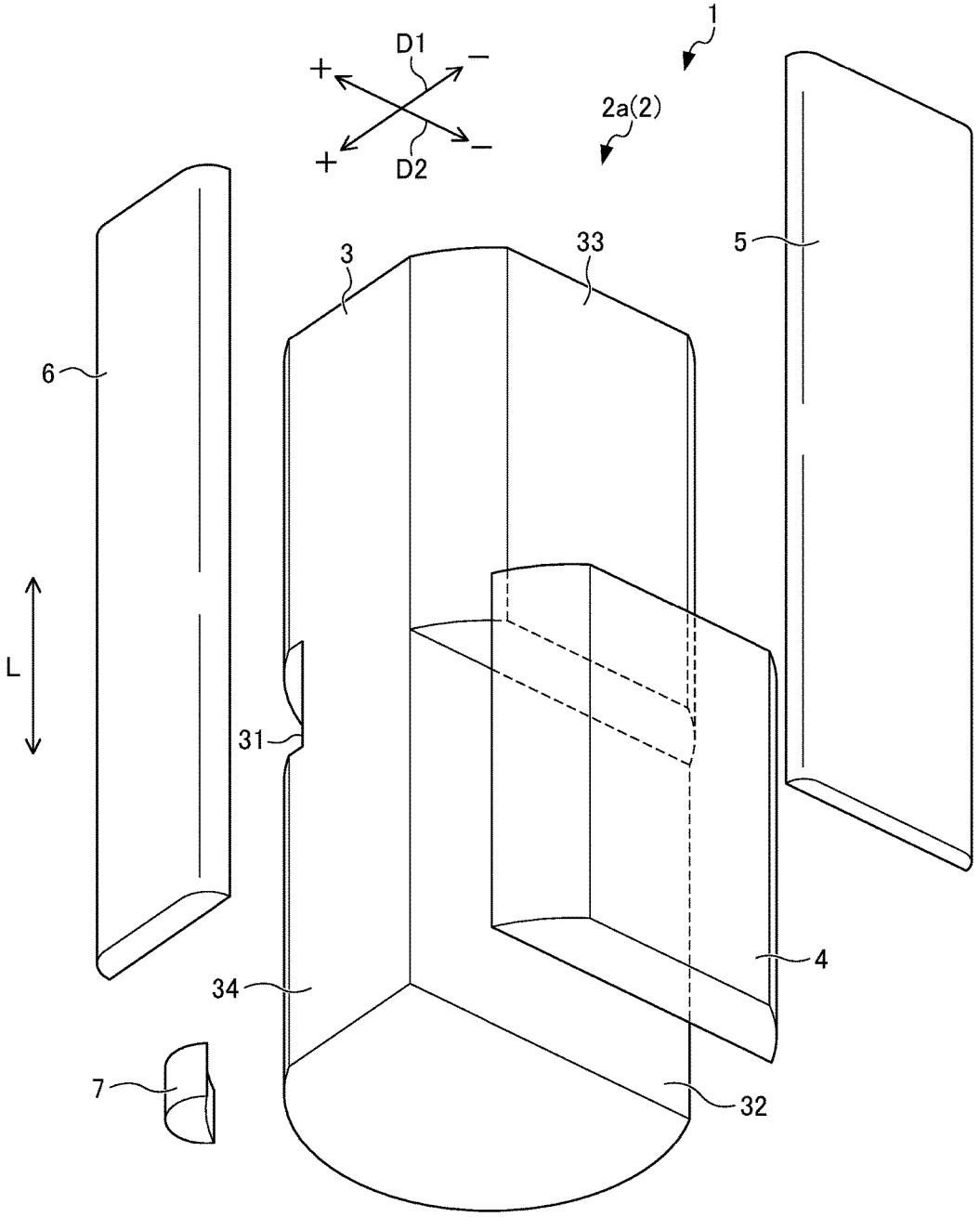
FIG. 3 is an exploded perspective view when viewing the grip body 2*a* from a different angle than FIG. 2.
Figure 4A:
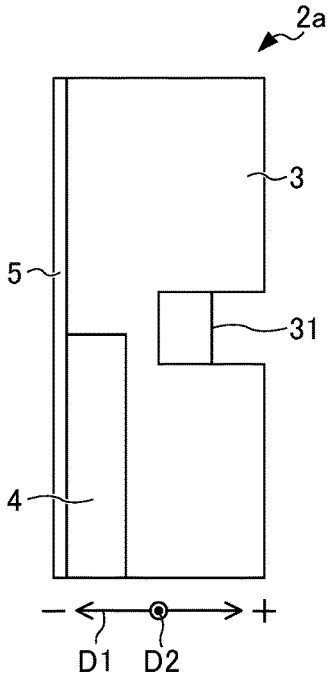
FIG. 4A is a view when viewing the grip body 2*a* shown in FIG. 1 from a minus side (inward side of left-hand grip body 2*a*) in a second direction D2 (left/right direction)
Figure 4B:
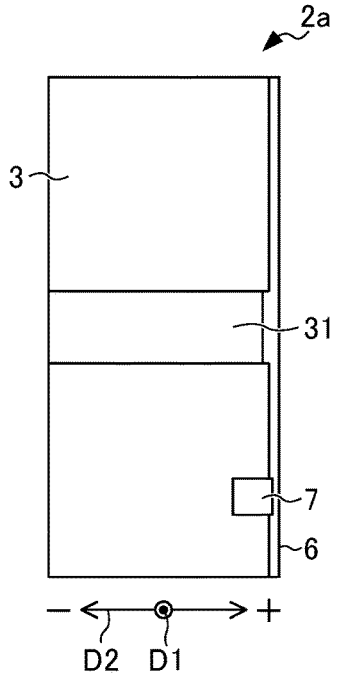
FIG. 4B is a view when viewing the grip body 2*a* shown in FIG. 1 from a plus side (forward side) in a first direction D1 (forward/rearward direction)
Figure 4C:
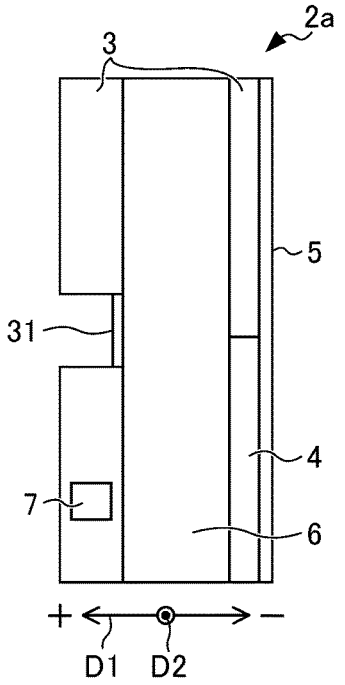
FIG. 4C is a view when viewing the grip body 2*a* shown in FIG. 1 from a plus side (outward side of left-hand grip body 2*a*) in a second direction D2 (left/right direction)
Figure 4D:
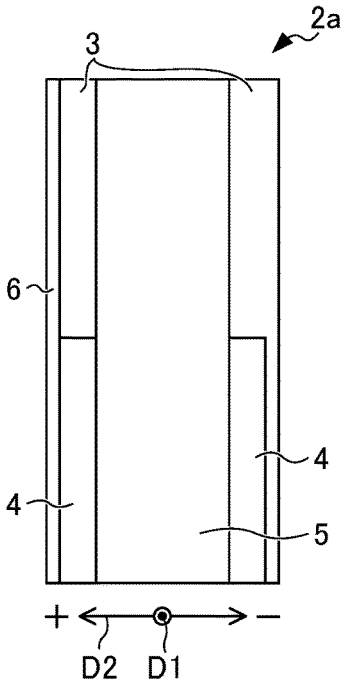
FIG. 4D is a view when viewing the grip body 2*a* shown in FIG. 1 from a minus side (rearward side) in a first direction D1 (forward/rearward direction)

An exercise assisting device 1 of a first embodiment according to the present invention will be explained in detail while referencing the drawings as appropriate. FIG. 1 is a perspective view showing a left-hand grip body 2*a* of the exercise assisting device 1 of the first embodiment according to the present invention. FIG. 2 is an exploded perspective view of the grip body 2*a*. FIG. 3 is an exploded perspective view when viewing the grip body 2*a* from a different angle than FIG. 2. FIG. 4A is a view when viewing the grip body 2*a* shown in FIG. 1 from a minus side (inward side of left-hand grip body 2*a*) in the second direction D2 (left/right direction), FIG. 4B is a view when viewing the grip body 2*a* shown in FIG. 1 from a plus side (forward side) in the first direction D1 (forward/rearward direction), FIG. 4C is a view when viewing the grip body 2*a* shown in FIG. 1 from a plus side (outward side of left-hand grip body 2*a*) in the second direction D2 (left/right direction), and FIG. 4D is a view when viewing the grip body 2*a* shown in FIG. 1 from a minus side (rearward side) in the first direction D1 (forward/rearward direction).

The exercise assisting device 1 according to the present invention is used in running such as sprinting and jogging, walking, etc. The exercise assisting device 1 includes a pair of left and right grip bodies 2. The pair of grip bodies 2 is configured by a pair for the left hand and for the right hand. In the exercise assisting device 1, a left-hand grip body 2*a* and right-hand grip body 2*b* are used simultaneously upon normal use. The grip body 2*a* shown in FIGS. 1 to 4D of the present embodiment will be explained for the left hand. The respective constituent members configuring the left-hand grip body 2*a* explained below are left/right symmetrical with the respective constituent members configuring the right-hand grip body 2*b*. It should be noted that the right-hand grip body 2*b* is illustrated in FIGS. 8A to 11B, but is omitted from illustration in FIGS. 1 to 7.

The left-hand grip body 2*a* includes a left-hand gripping member 3 (gripping member), first weight member 4, second weight member 5, third weight member 6, and projecting member 7 (projecting part), as shown in FIGS. 1 to 4D.

It should be noted that the direction in which the gripping member 3 extends in the illustrations is referred to as longitudinal direction L. In addition, the first direction D1 and second direction D2 of the grip body 2*a* are directions orthogonal to each other. The first direction D1 and second direction D2 are each orthogonal to the longitudinal direction L. The first direction D1 is the forward/rearward direction of the gripping member 3, which is a direction corresponding to the forward/rearward direction of a person when viewing from a person gripping the gripping member 3, in a case of gripping the gripping member 3 forward of the person in a state standing up the gripping member 3 (refer to FIG. 5). In the first direction D1, the plus (+) side corresponds to the forward side of a person, and the minus (−) side corresponds to the rearward side of a person.

Figure 5:
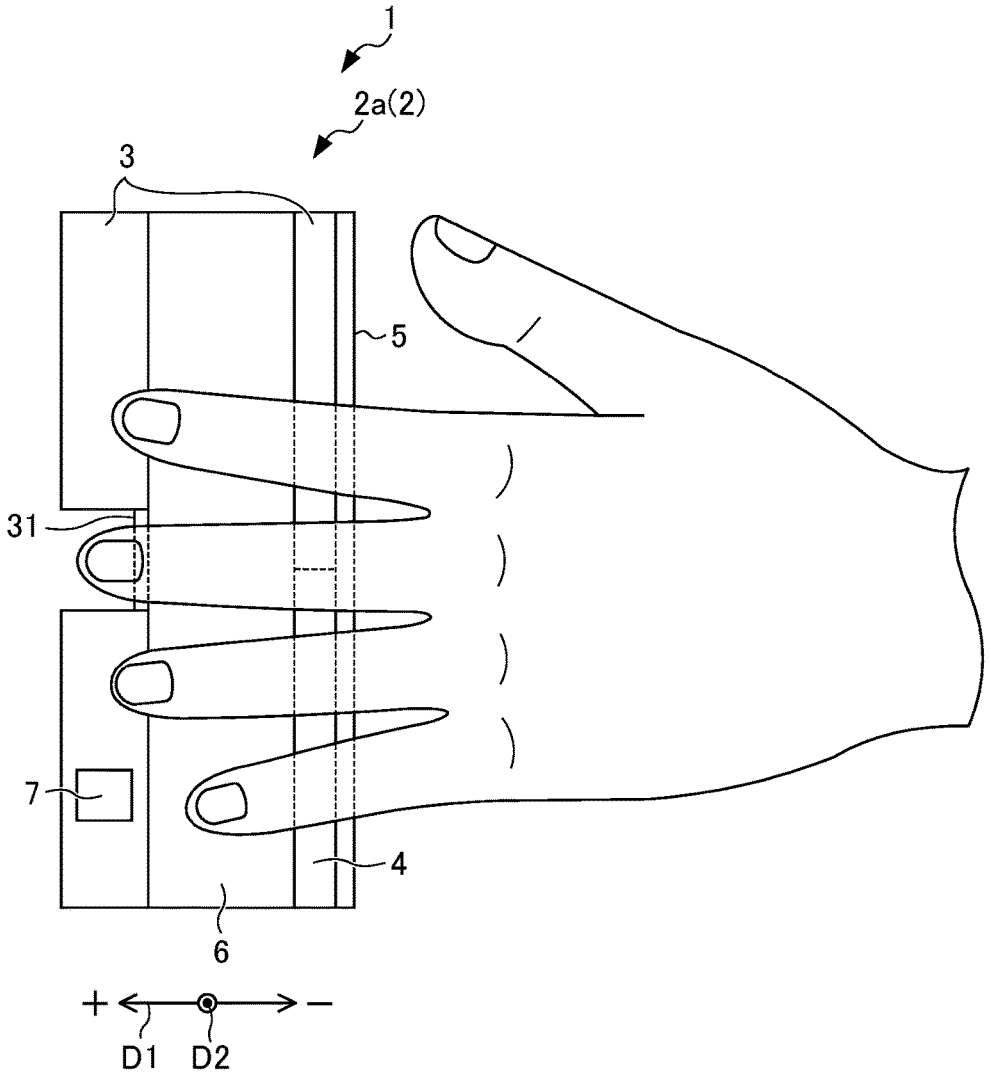
FIG. 5 is a view illustrating a way of gripping of the grip body 2*a*, and illustrates a state disposing a middle finger in a recess groove 31 of a gripping member 3.

The second direction D2 is the left/right direction of the gripping member 3, which is a direction corresponding to the left/right direction of a person when viewing from a person gripping the gripping member 3, in the case of gripping the gripping member 3 forward of the person in a state standing up the gripping member 3 (refer to FIG. 5).

The plus (+) side in the second direction D2 is one outward side of the gripping member 3, and corresponds to either outward side in the left/right direction of a person. More specifically, the plus (+) side (outward side) in the second direction D2 (left/right direction) is the left side with the left-hand gripping member 3 as a reference, in the case of gripping the left-hand gripping member 3. In addition, the plus (+) side (outward side) in the second direction D2 (left/right direction) is the right side with the right-hand gripping member 3 as a reference, in the case of gripping the right-hand gripping member 3.

The minus (−) side in the second direction D2 is one inward side of the gripping member 3, and corresponds to either inward side in the left/right direction of a person. More specifically, the minus (−) side (inward side) in the second direction D2 (left/right direction) is the right side with the left-hand gripping member 3 as a reference, in the case of gripping the left-hand gripping member 3. In addition, the minus (−) side (inward side) in the second direction D2 (right/left direction) is the left side with the right-hand gripping member 3 as a reference, in a case of gripping the right-hand gripping member 3.

It should be noted that, since the grip body 2*a* is swung in a state gripped by a person, the orientation of the grip body 2*a* when viewing from the person gripping the gripping member 3 changes according to the position of the grip body 2*a*.

The gripping member 3 extends in the longitudinal direction L, as shown in FIGS. 1 to 4D. The gripping member 3 is formed in a tubular or columnar shape that can be gripped by the left hand. In the present embodiment, the gripping member 3 is substantially circular tube shape or substantially circular column shape. It should be noted that the gripping member 3 is not limited to a substantially circular tube shape or substantially circular column shape, and may be a polygonal tube or polygonal columnar shape.

The thickness of the gripping member 3 is a thickness enabling gripping of the gripping member 3 in a state stretching fingers along the circumferential direction of the gripping member 3. The material of the gripping member 3 is preferably a light-weight raw material, and is configured by plastic, cardboard material, or the like, for example. In addition, the material of the gripping member 3 is preferably a raw material conformable to the hand.

A recess groove 31 (recessed part) is provided to the gripping member 3. The recess groove 31 is formed in a groove shape extending in the second direction D2 (left/right direction) in the surface on the plus side (forward side) in the first direction D1 (forward/rearward direction), at a substantially central part in the longitudinal direction L. The recess groove 31 is a portion of the gripping member 3 at which only a portion at which the middle finger is arranged sinks in, upon gripping the gripping member 3 by hand. The width of the groove of the recess groove 31 is a width allowing to dispose the middle finger therein.

The gripping member 3 has a first weight mounting part 32, second weight mounting part 33, third weight mounting part 34, and projection mounting part 35, as shown in FIG. 2. The first weight mounting part 32 and second weight mounting part 33 are formed in a planar shape at a lateral part on the minus side (rearward side) in the first direction D1 (forward/rearward direction) of the gripping member 3. The third weight mounting part 34 is formed in a planar shape at a lateral part on the plus side (outward side) in the second direction D2 (left/right direction) of the gripping member 3.

The first weight member 4 described later is mounted to the first weight mounting part 32. The first weight mounting part 32 is a flat surface on the minus side (rearward side) in the first direction D1 (forward/rearward direction) of the gripping member 3. The first weight mounting part 32 is configured by a flat surface that is substantially half of the gripping member 3 on a lower side from substantially the center in the longitudinal direction L. The first weight mounting part 32 is a flat surface a step lower than the second weight mounting part 33 described later.

The second weight member 5 described later is mounted to the second weight mounting part 33. The second weight mounting part 33 is a flat surface on a minus side (rearward side) in the first direction D1 (forward/rearward direction) of the gripping member 3. The second weight mounting part 33 is configured by a flat surface that is substantially half of the gripping member 3 on an upper side from substantially the center in the longitudinal direction L. The second weight mounting part 33 is a flat surface raised above the first weight mounting part 32.

The third weight member 6 described later is mounted to the third weight mounting part 34. The third weight mounting part 34 is a flat surface on a plus side (outward side) in the second direction D2 (left/right direction) of the gripping member 3. The third weight mounting part 34 is a flat surface extending along the entire range of the longitudinal direction L.

The projecting member 7 described later is mounted to the projection mounting part 35. The projecting member 7 mounted to the projection mounting part 35 is arranged between the ring finger and pinky finger when gripping the gripping member 3. The projection mounting part 35 is a curved surface of a predetermined range provided near the third weight mounting part 34 at a lower side, on the outer circumferential face on the plus side (forward side) in the first direction D1 (forward/rearward direction) of the gripping member 3, as shown in FIG. 2.

The first weight member 4, second weight member 5 and third weight member 6 are weights for balance adjustment of the gripping member 3. The first weight member 4, second weight member 5 and third weight member 6 are configured from a raw material having greater specific gravity than the raw material of the gripping member 3, for example, metal.

The first weight member 4, second weight member 5 and third weight member 6 are each configured to be removable relative to the gripping member 3, as shown in FIGS. 1 to 4D. The first weight member 4, second weight member 5 and third weight member 6 can each be set by selecting the weight. The first weight member 4, second weight member 5 and third weight member 6 can be set by appropriately selecting weights and combinations.

The first weight member 4 is mounted to the first weight mounting part 32 of the gripping member 3. The first weight member 4 is mounted to substantially half on the lower side of a flat surface of the first weight mounting part 32 that is on the minus side (rearward side) in the first direction D1 (forward/rearward direction) of the gripping member 3. The first weight member 4 extends in the longitudinal direction L of the gripping member 3. The first weight member 4 is a plate member that is parallel to the longitudinal direction L and second direction D2 (left/right direction).

The second weight member 5 is mounted to straddle a surface on the minus side (rearward side) in the first direction D1 (forward/rearward direction) of the first weight member 4 and the flat surface of the second weight mounting part 33, after the first weight member 4 is mounted to the gripping member 3. The second weight member 5 extends along the entire range in the longitudinal direction L of the gripping member 3. The second weight member 5 is a plate member that is parallel to the longitudinal direction L and second direction D2 (left/right direction).

The third weight member 6 is mounted to the third mounting part 34 of the gripping member 3. The third weight member 6 is mounted to the third weight mounting part 34 on the plus side (outward side) in the second direction D2 (left/right direction) of the gripping member 3. The third weight member 6 extends in the longitudinal direction L of the gripping member 3. The third weight member 6 is a plate member that is parallel to the longitudinal direction L and first direction D1 (forward/rearward direction).

The projecting member 7 is configured to be removable relative to the gripping member 3. For example, the projecting member 7 has a fitting convex part (not illustrated), and the gripping member 3 has a fitting recessed part (not illustrated). By the fitting convex part of the projecting member 7 fitting together with the fitting recessed part of the gripping member 3, the projecting member 7 makes a configuration removable relative to the gripping member 3.

The projecting member 7 is mounted to the projection mounting part 35. The projecting member 7 protrudes from an outer face of the gripping member 3 to outside. The projecting member 7 is arranged between the ring finger and pinky finger when gripping the gripping member 3. The projecting member 7 is arranged at the projection mounting part 35 near the third weight member 6 below on the plus side (outward side) in the second direction D2 (left/right direction), at the plus side (forward side) in the first direction D1 (forward/rearward direction) of the gripping member 3. The projecting member 7 is installed upon using the exercise assisting device 1 in a horizontal operation mode described later, and is used as an optional member.

Figure 6A:
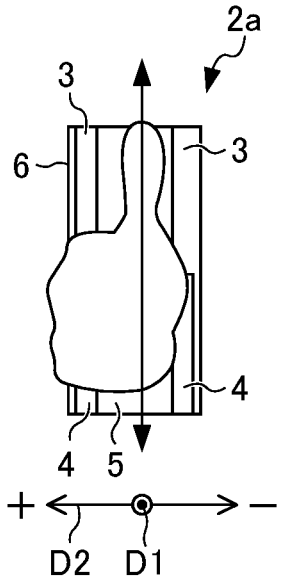
FIG. 6A is a view illustrating a way of gripping of the grip body 2*a*, and illustrates a state arranging a thumb on the grip body 2*a;*
Figure 6B:
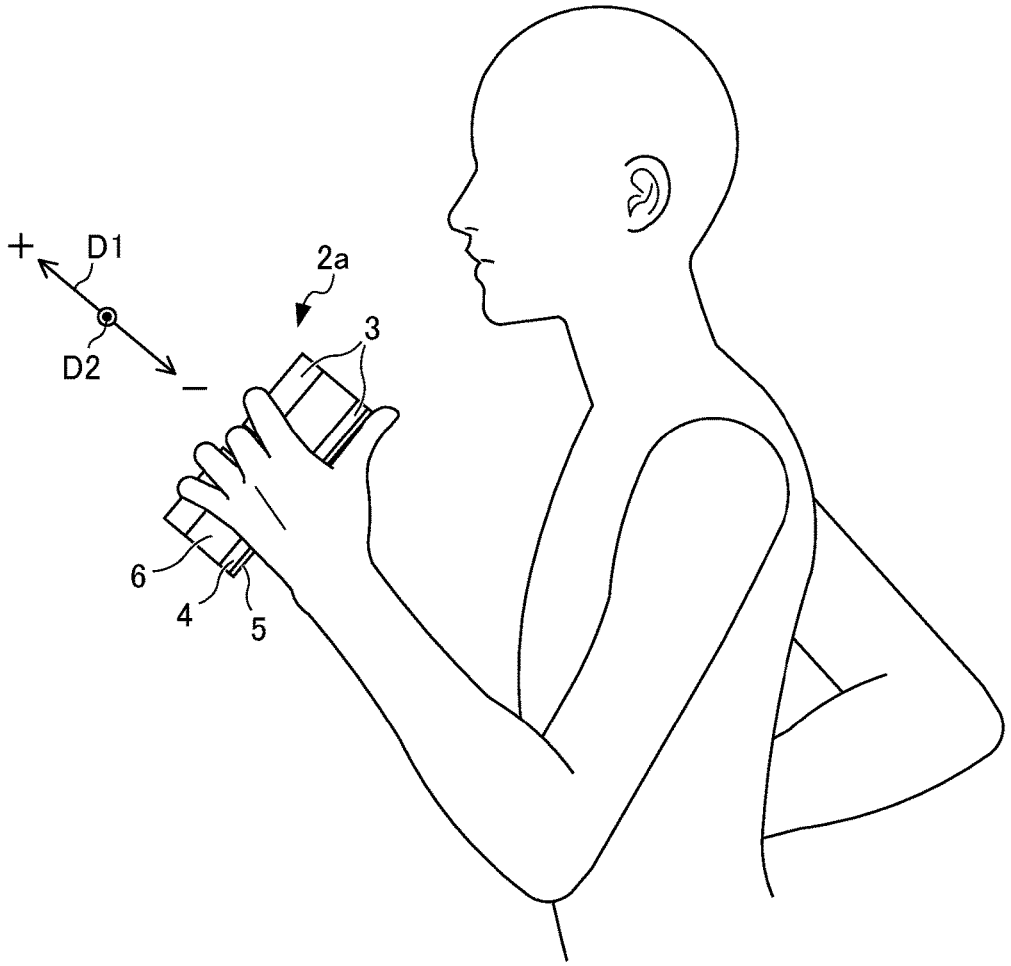
FIG. 6B is a view illustrating a way of gripping of the grip body 2*a*, and illustrates a state arranging a thumb on the grip body 2*a;*
Figure 7:
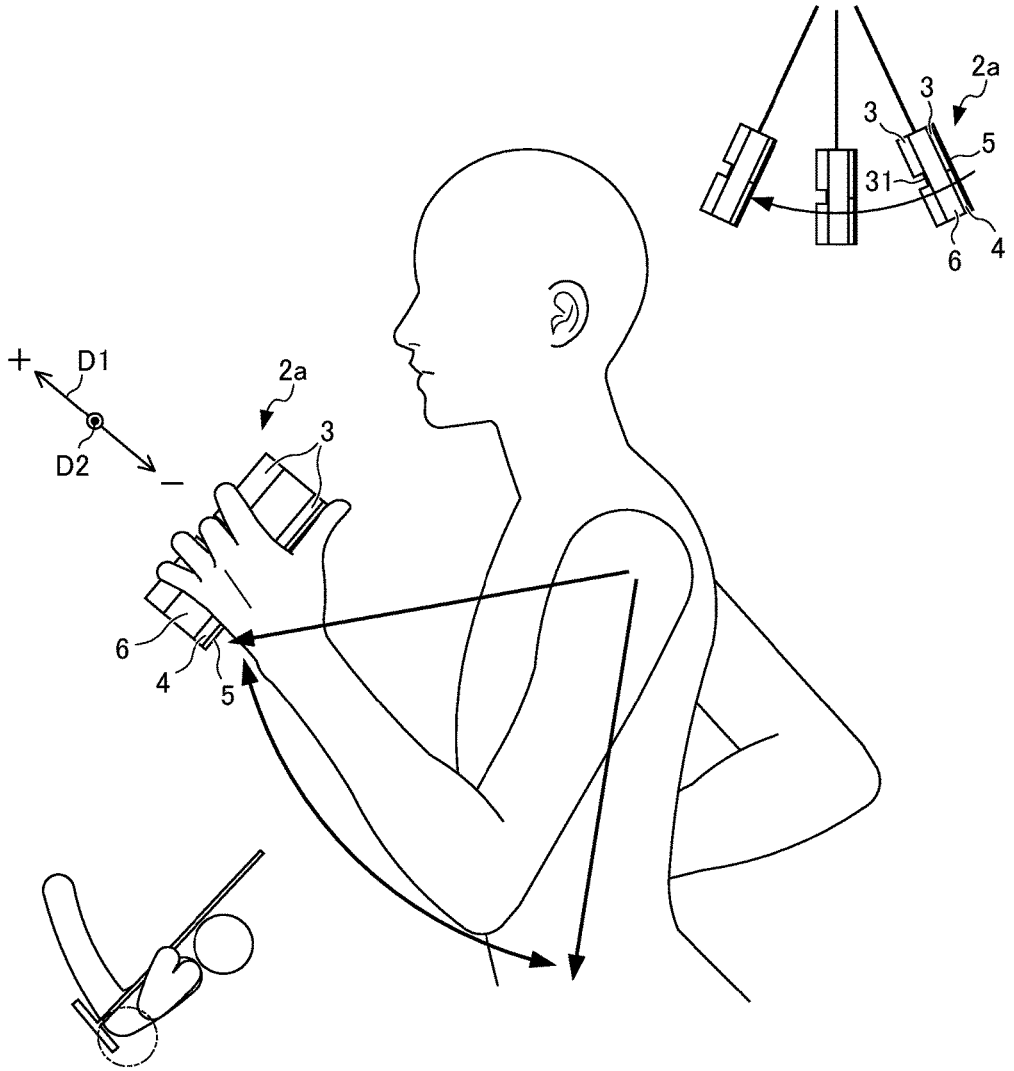
FIG. 7 is a view illustrating functions of a first weight member 4.
Figure 8A:
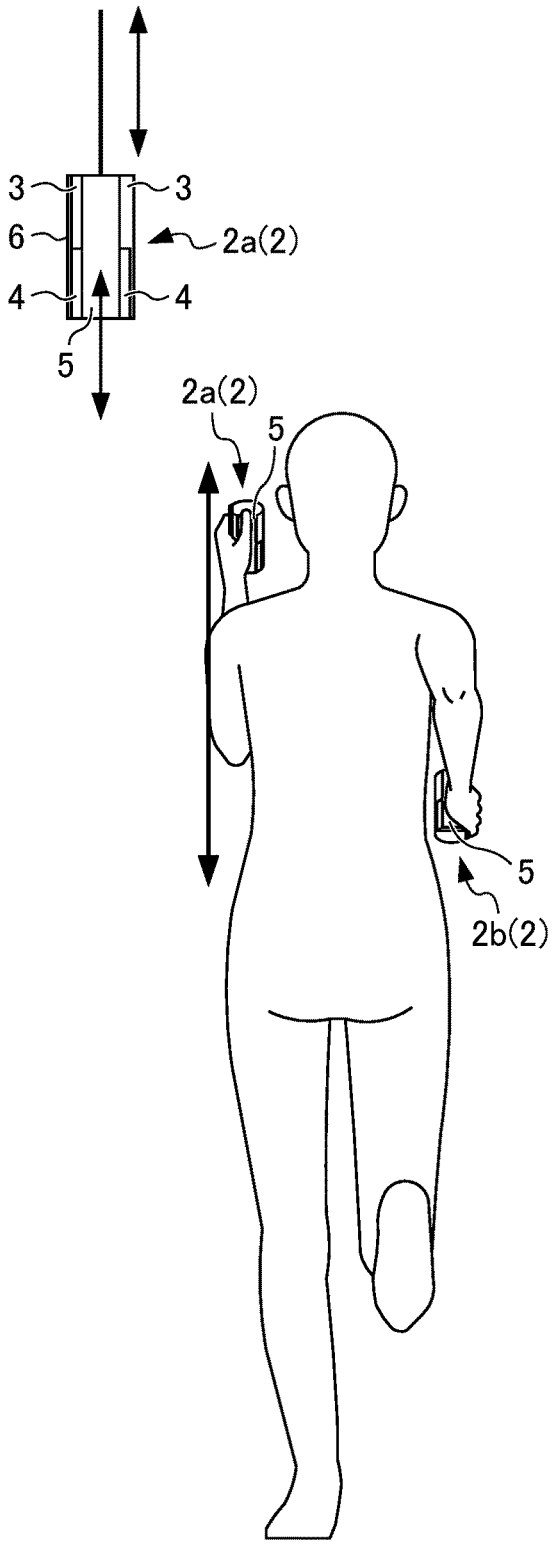
FIG. 8A is a view illustrating functions of a second weight member 5.
Figure 8B:
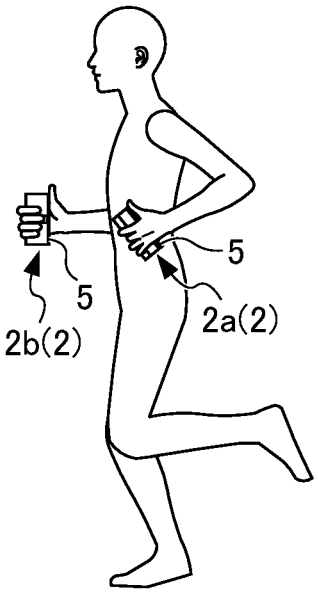
FIG. 8B is a view illustrating functions of the second weight member 5.
Figure 8C:
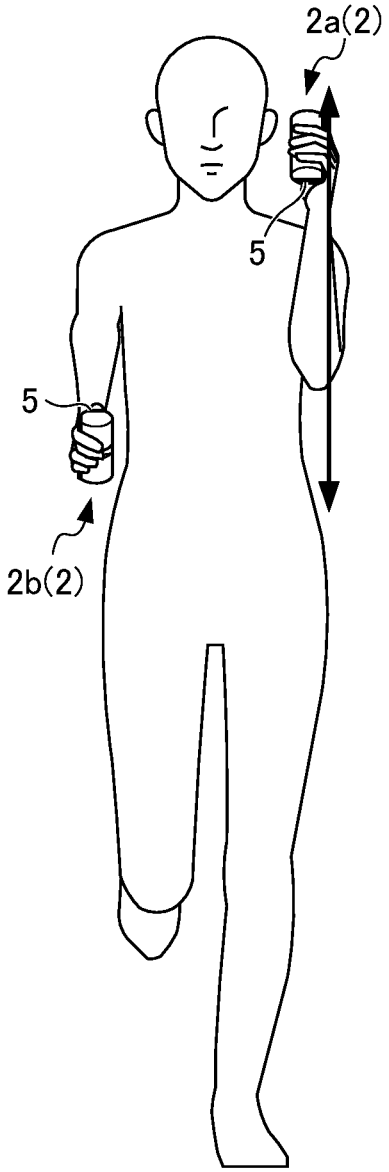
FIG. 8C is a view illustrating functions of the second weight member 5.
Figure 9A:
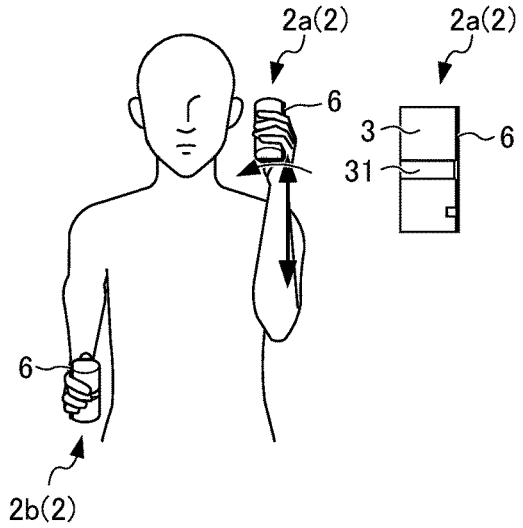
FIG. 9A is a view illustrating functions of a third weight member 6.
Figure 9B:
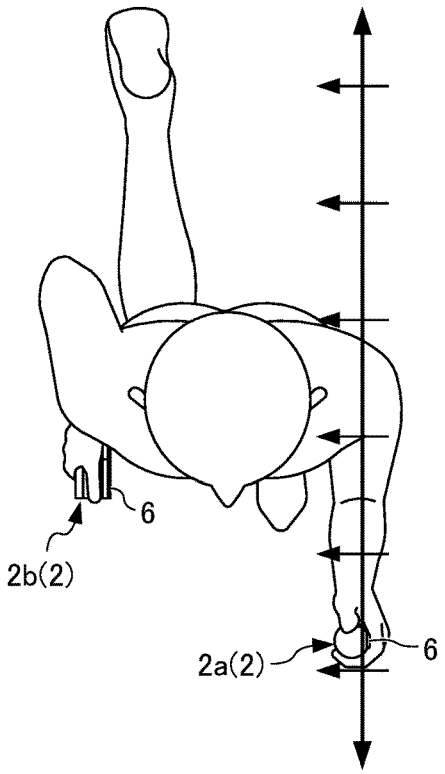
FIG. 9B is a view illustrating functions of the third weight member 6.
Figure 10:
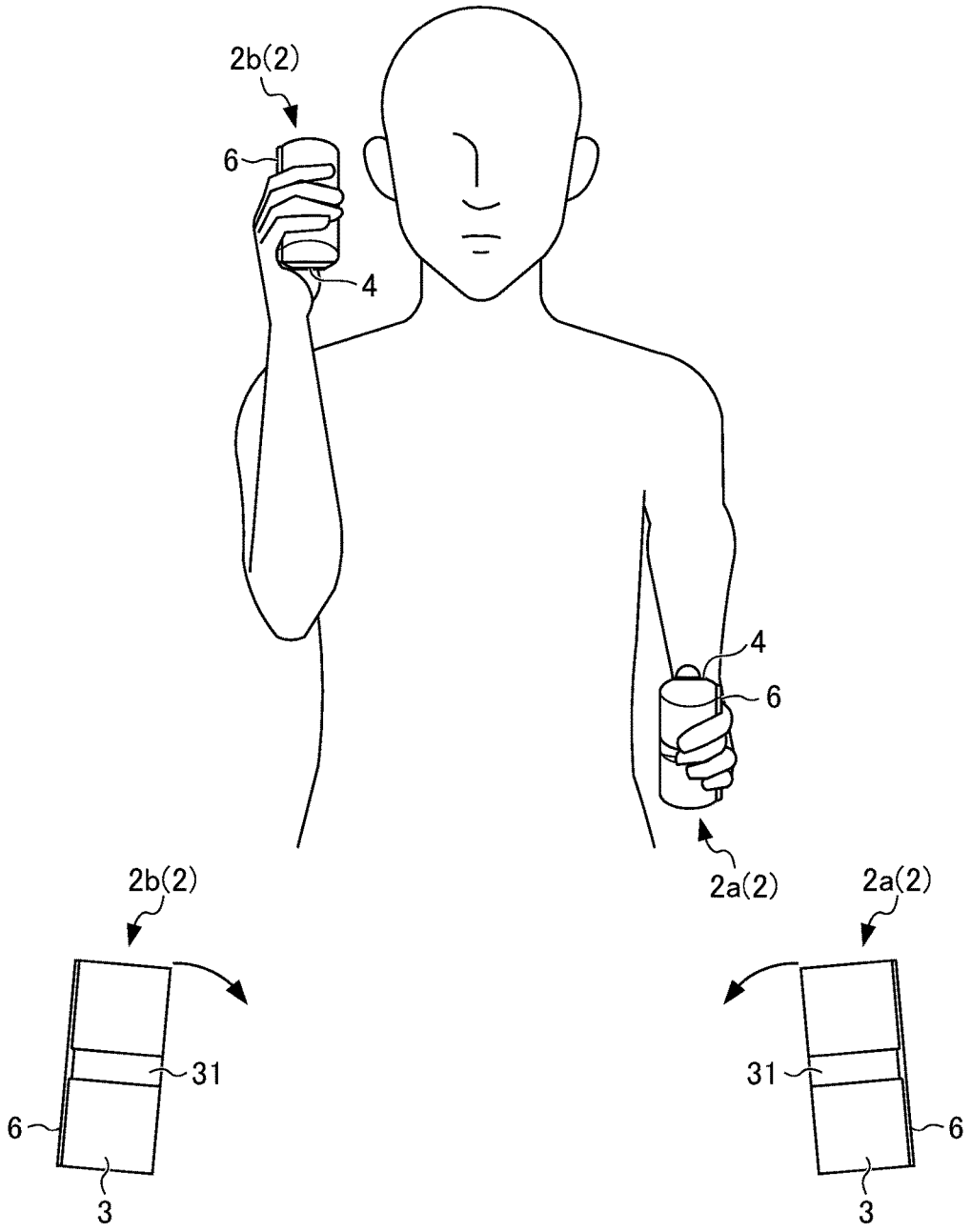
FIG. 10 is a view illustrating functions exerted by providing both the first weight member 4 and third weight member 6.
Figure 11A:
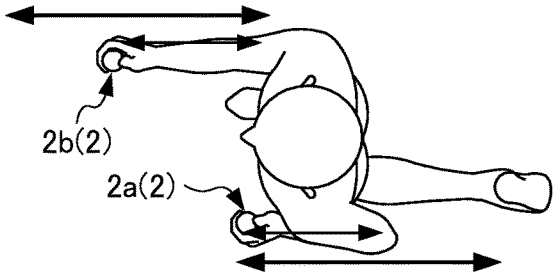
FIG. 11A is a view illustrating functions of a projecting member 7.
Figure 11B:
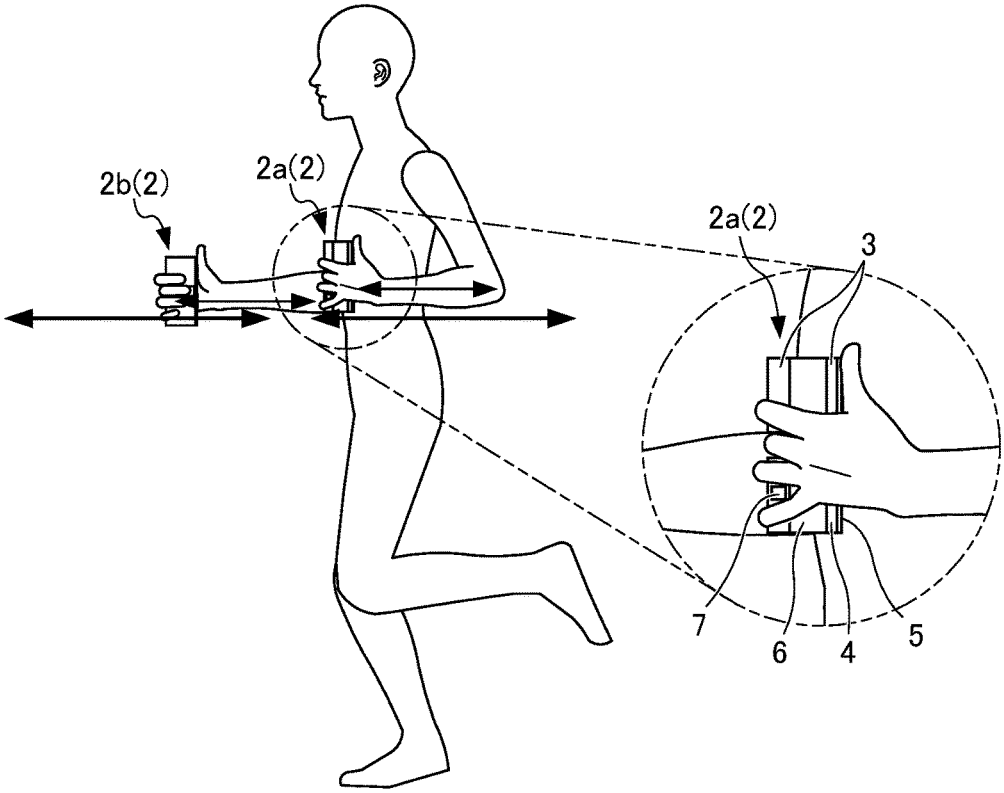
FIG. 11B is a view illustrating functions of the projecting member 7.

Next, the method of use of the exercise assisting device 1 and function of each member will be explained while referencing the drawings. FIG. 5 is a view illustrating a way of gripping of the grip body 2*a*, and illustrates a state arranging the middle finger in the recess groove 31 of the gripping member 3. FIGS. 6A and 6B are views illustrating the way of gripping of the grip body 2*a*, and illustrate a state arranging the thumb on the grip body 2*a*. FIG. 7 is a view illustrating functions of the first weight member 4. FIGS. 8A to 8C are views illustrating functions of the second weight member 5. FIGS. 9A and 9B are views illustrating functions of the third weight member 6. FIG. 10 is a view illustrating functions exerted by jointly providing the first weight member 4 and third weight member 6. FIGS. 11A and 11B are views illustrating functions of the projecting member 7.

First, the method of use of the exercise assisting device 1 will be explained. The middle finger is disposed in the recess groove 31 of the gripping member 3, as shown in FIGS. 5 to 6B, upon gripping the grip body 2 of the exercise assisting device 1. At the same time, the thumb is made to contact the second weight member 5, by configuring so as to allot from a portion of a joint of the thumb (ball of the thumb) until a portion of the leading end thereof in a state standing up the thumb to the second weight member 5, as shown in FIGS. 6A and 6B. The grip body 2 is gripped in this state.

In addition, upon using the exercise assisting device 1 in a horizontal operation mode described later, the projecting member 7 is mounted to the gripping member 3 as an optional member, and the grip body 2 is gripped in a state disposing the projecting member 7 between the ring finger and pinky finger (refer to FIGS. 11A and 11B).

Upon running such as jogging or upon walking, the arms are swung in the forward/rearward direction, in a state gripping the grip bodies 2 with both hands, respectively. The grip bodies 2 gripped in both respective hands thereby are swung in the forward/rearward direction.

Herein, regarding the main characteristic structures of the exercise assisting device 1, the function for the way of swinging of the arms upon running or upon walking will be explained.

The function of the recess groove 31 of the gripping member 3 will be explained.

In the case of running or walking without using the exercise assisting device 1 of the present invention, compared to a case of using the exercise assisting device 1 of the present invention, the running or walking may not be stable, as in the first running state, second running state, third running state and fourth running state explained next.

The first running state is a state of strongly clenching the fist, and running or walking by drawing back elbows, without using any device. In the first running state, due to strongly clenching the fist, the first is stable, and the arms tend to move in the vertical direction. However, in the first running state, power is placed in the fist, and enters a state where the armpit is excessively tight; therefore, it is a state where it is difficult to greatly draw back the elbow to behind. For this reason, it is difficult to draw the elbow backwards, and running tends to destabilize.

The second running state is a state opening fingers other than the index finger, as well as placing force only on the index finger to bend, without using any device, and is a running or walking state. In the second running state, it becomes a state where the palm heel of the hand (lower part of palm) faces down, and the armpit is open. For this reason, running tends to become unstable due to the arm being swung in the forward/rearward direction in a state of the armpit opened.

The third running state is a state placing force on only the pinky finger or ring finger to bend, and opening fingers other than the bent finger, without using any device, and is a state of running or walking. In the third running state, it becomes a state where the palm heel of the hand (lower part of palm) faces up, and the armpit is open. For this reason, running tends to become unstable due to the arm being swung in the forward/rearward direction in a state of the armpit opened.

The fourth running state is a state of running or walking using a normal baton of cylindrical shape without irregularities in the circumferential face, and gripping this baton. In the fourth running state, due to a plurality of fingers being disposed on the circumferential face of a baton without irregularities, the extent of force on each finger is unbalanced, and lacks stability. In addition, in the fourth running state, since the balance of force on the fingers varies upon the arm moving, the wrist will tend to move irregularly to the right and left. For this reason, running tends to become unstable.

In this way, in the first running state, second running state, third running state and fourth running state, running tends to become unstable. In contrast, according to the present invention, the gripping member 3 can be gripped in a state disposing the middle finger in the recess groove 31. It is thereby possible to swing the arm in the forward/rearward direction in a state in which the armpit is tight. In addition, it is possible to swing the arm in the vertical direction in a state making the first follow right beside the body. Furthermore, it is possible to greatly draw the elbow backwards, upon swinging the arm.

Next, the functions of the first weight member 4, second weight member 5 and third weight member 6 will be explained. Herein, for explanation of the functions of the first weight member 4, second weight member 5 and third weight member 6, it will be explained in a state in which the first weight member 4, second weight member 5 and third weight member 6 are mounted to the gripping member 3. It should be noted that the projecting member 7 is not mounted to the gripping member 3 in the explanation of functions of the first weight member 4, second weight member 5 and third weight member 6.

First, the functions of the first weight member 4 will be explained.

The first weight member 4 is arranged at a lower part on the rearward side (minus side) in the forward/rearward direction (first direction D1) of the gripping member 3. As shown in FIG. 7, the first weight member 4 has a low center of gravity at the lower part on the rearward side of the gripping member 3. By the first weight member 4 being a low center of gravity of the gripping member 3, and gripping the grip bodies 2 in both hands and swinging in the forward/rearward direction, the arms are swung with the shoulders as the central axis. Herein, in the case of a trapeze being swung, the trapeze will be a very fast swing since the center of weight of a person riding the trapeze is a low position, as shown in FIG. 7. Similarly to this, in the present invention, since the first weight member 4 is arranged at a lower part on the rearward side of the gripping member 3, swinging of the arm can be strongly enforced by the low center of gravity of the first weight member 4, as in a trapeze being swung.

Next, the functions of the second weight member 5 will be explained.

The second weight member 5 extends in the longitudinal direction L of the gripping member 3, as well as being arranged on the rearward side (minus side) in the forward/rearward direction (first direction D1) of the gripping member 3. Herein, the oblong weight structure has a high degree of stability for exercise in the vertical direction. Similarly to this, since the gripping member 3 is equipped with the second weight member 5 in the present invention as shown in FIGS. 8A to 8C, it is possible to stabilize exercise in the vertical direction. In the case of a person running or walking, it is thereby possible for the second weight member 5 to stabilize exercise in the vertical direction, upon swinging the grip body 2.

In addition, the thumb is made to contact the second weight member 5 in a state standing up the thumb, to grip the grip body 2. For this reason, it is possible to draw the elbow more greatly rearward.

Next, functions of the third weight member 6 will be explained.

The third weight member 6 is arranged at a lateral part on the outward side (plus side) in the left/right direction (second direction D2) of a person on the gripping member 3, as well as extending in the longitudinal direction L of the gripping member 3. As shown in FIGS. 9A and 9B, by gripping the grip bodies 2 with both hands and swinging in the forward/rearward direction, since the third weight member 6 is arranged on the outward side (plus side) in the left/right direction of the person's body, the force directed from the outside to inside of the person's body acts on the grip body 2. A force tightening the armpit thereby acts on the person's body. Therefore, the arms can be swung in the forward/rearward direction so that both arms become parallel. As a result thereof, since both arms are swung so as to run along a pair of parallel rails, it is possible to improve the straight running stability of the person's body.

Next, the functions exerted by jointly providing the first weight member 4 and third weight member 6 will be explained.

The present invention jointly provides the first weight member 4 and third weight member 6. For this reason, as shown in FIG. 10, the left and right grip bodies 2 are disposed in a substantially truncated chevron shape, so that an upper end of the gripping member 3 is positioned more to the inward side of the person's body than the lower end, at both left and right sides to the traveling direction of the person upon running or walking. In detail, the left and right grip bodies 2 are sloped in a substantially truncated chevron shape, so that the gap narrows as moving from downwards to upwards.

Herein, in order to raise the straight running stability of a vehicle, for example, the tires may be set to toe-in. Setting of tires to toe-in is the setting whereby the leading edges of the left and right tires lean so as to approach inward side in a substantially truncated chevron shape, when viewing the left and right tires from above. The setting of tires to toe-in is one setting in which the tires are arranged so that the traveling direction side becomes narrower, and raises the straight running stability of a vehicle. For this reason, similarly to the case of setting the tires to toe-in, the arms are swung in a state with the upper ends of the left and right grip bodies 2 disposed so as to be positioned more to the inward side of the person's body than the lower end, as shown in FIG. 10, upon running or walking in the present invention. It is thereby possible to raise the straight running stability of a person's body.

Next, the functions of the projecting member 7 will be explained. The projecting member 7 is installed upon using the exercise assisting device 1 in the horizontal movement mode described later, and is used as an optional member. In the explanation of the functions of the projecting member 7, it is explained in a state in which the first weight member 4, second weight member 5, third weight member 6 and projecting member 7 are mounted to the gripping member 3.

The projecting member 7 is arranged between the ring finger and pinky finger upon gripping the grip body 2. For this reason, it is possible to grip the grip body 2 in a state arranging the projecting member 7 between the ring finger and pinky finger to spread out the ring finger and pinky finger. Then, as shown in FIGS. 11A and 11B, by force being placed on the arms in a state spreading out the ring finger and pinky finger, the projecting member 7 (portion between ring finger and pinky finger) and elbow are fixed to be linked in a straight line in the forward/rearward direction, which is a horizontal direction. In a state fixing the projecting member 7 (portion between ring finger and pinky finger) and elbow, a great force increases below the armpit and side flank, and force acts from below the armpit towards the side flank, by repeatedly swinging the arms in a straight line in a horizontal state in the forward/rearward direction. Therefore, by equipping the projecting member 7, the horizontal movement of the arms tends to be carried out, and it is possible to promote force acting from both armpits towards the side flanks.

It should be noted that, in a state fixing the projecting member 7 (portion between ring finger and pinky finger) and elbow, the movement of swinging the arm in a straight line in a horizontal state in the forward/rearward direction (horizontal movement of arm) is movement not obtained by everyday movement. For this reason, by equipping the projecting member 7, it is possible to promote force acting from both arms towards the side flanks by easily realizing movement that is not obtained in everyday movement.

The following such effects are exerted according to the exercise assisting device 1 of the present embodiment explained above, for example.

The first embodiment provides a pair of gripping members 3 that extend in a tubular shape or columnar shape that can be gripped by both hands, respectively, and the gripping member 3 has a recess groove 31 in which only a portion in which the middle finger is disposed when gripping by hand is recessed. For this reason, when gripping the gripping member 3 by disposing the middle finger in the recess groove 31, it is possible to swing the arm in the forward/rearward direction in a state in which the armpit is tight. In addition, it is possible to swing the arm in the vertical direction in a state causing the first to follow right beside the body. In addition, upon swinging the arm, it is possible to draw the elbow greatly backward. As a result thereof, it is possible to properly swing the arm, and it is possible to stabilize the way of swinging of the arm.

In addition, the present embodiment further provides a first weight member 4 disposed at a lower part on a rearward side (minus side) in the forward/rearward direction (first direction D1) of the gripping member 3, in the case of gripping forward in a state erecting the gripping member 3. For this reason, it is possible to gradually strengthen swinging of the arm greatly, by swinging according to the low center of gravity of the first weight member 4, as in a trapeze being swung, due to the first weight member 4 being disposed at the lower part on the rearward side of the gripping member 3. It is thereby possible to properly swing the arms, and possible to stabilize the way of swinging of arms.

In addition, the present embodiment further provides the second weight member 5 disposed on a rearward side (minus side) in the forward/rearward direction (first direction D1) of the gripping member 3, as well as extending in the longitudinal direction L of the gripping member 3, when gripped forward in a state standing up the gripping member 3. For this reason, the second weight member 5 can stabilize exercise in the vertical direction, upon swinging the gripping member 3, in the case of a person running or walking. It is thereby possible to properly swing the arms, and possible to stabilize the way of swinging of arms.

In addition, the grip body 2 is gripped by causing the thumb to contact the second weight member 5 in a state standing up the thumb. For this reason, it is possible to more greatly draw the elbow rearward.

In addition, the present embodiment further provides the third weight member 6 disposed at a lateral part on the outward side (plus side) in the left/right direction (second direction D2) of a person's body of the gripping member 3, when gripping forward in a state standing up the gripping member 3. For this reason, a force from outside of the person's body towards the inside acts on the gripping member 3. A force to tighten the armpit thereby acts on the person's body. Therefore, the arms are swung in the forward/rearward direction so that both arms become parallel. As a result thereof, since both arms are swung so as to run along parallel rails, it is possible to raise the straight running stability of the person's body.

In addition, the present embodiment jointly provides the first weight member 4 and third weight member 6. For this reason, the arms are swung in a state in which the left and right gripping members 3 are disposed so that the upper ends are positioned more on the inward side of the person's body than the lower ends, upon running or walking. It is thereby possible to raise the straight running stability of a person's body. Therefore, it is possible to raise the straight running stability. As a result thereof, it is possible to properly swing the arms, and possible to stabilize the way of swinging of arms.

In addition, the present embodiment further provides the projecting member 7 disposed between the ring finger and pinky finger, when gripping the gripping member 3. For this reason, it is possible to grip the grip body 2 in a state disposing the projecting member 7 between the ring finger and pinky finger to spread out the ring finger and pinky finger. In a state fixing the projecting member 7 (portion between ring finger and pink finger) and elbow, a force acts from below the armpit towards the side flank, by repeatedly swinging the arm in a straight line in a horizontal state in the forward/rearward direction. Therefore, horizontal movement of the arms can be carried out easily, and it is possible to promote force acting from both armpits toward the side flanks.

Figure 12:
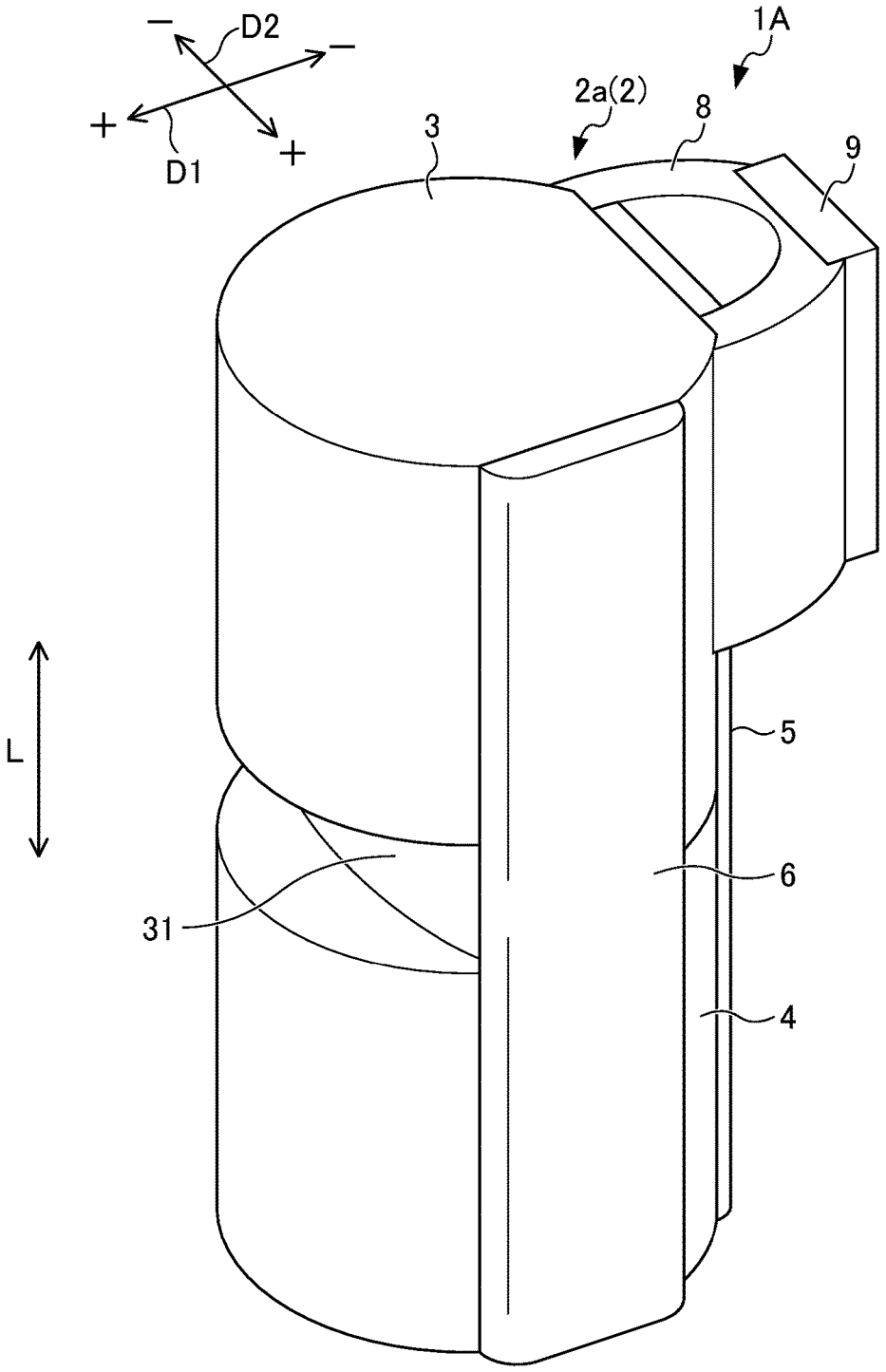
FIG. 12 is a perspective view showing a left-hand grip body 2*a* of an exercise assisting device 1A according to a second embodiment of the present invention.
Figure 13A:
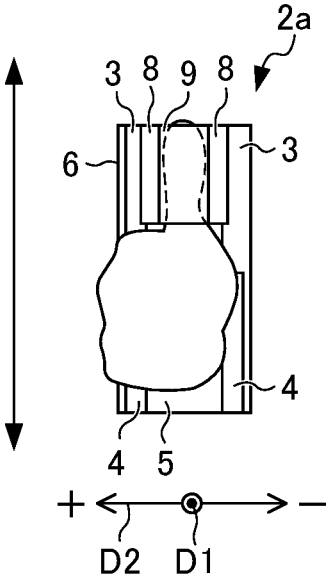
FIG. 13A is a view illustrating functions of a fourth weight member 9.
Figure 13B:
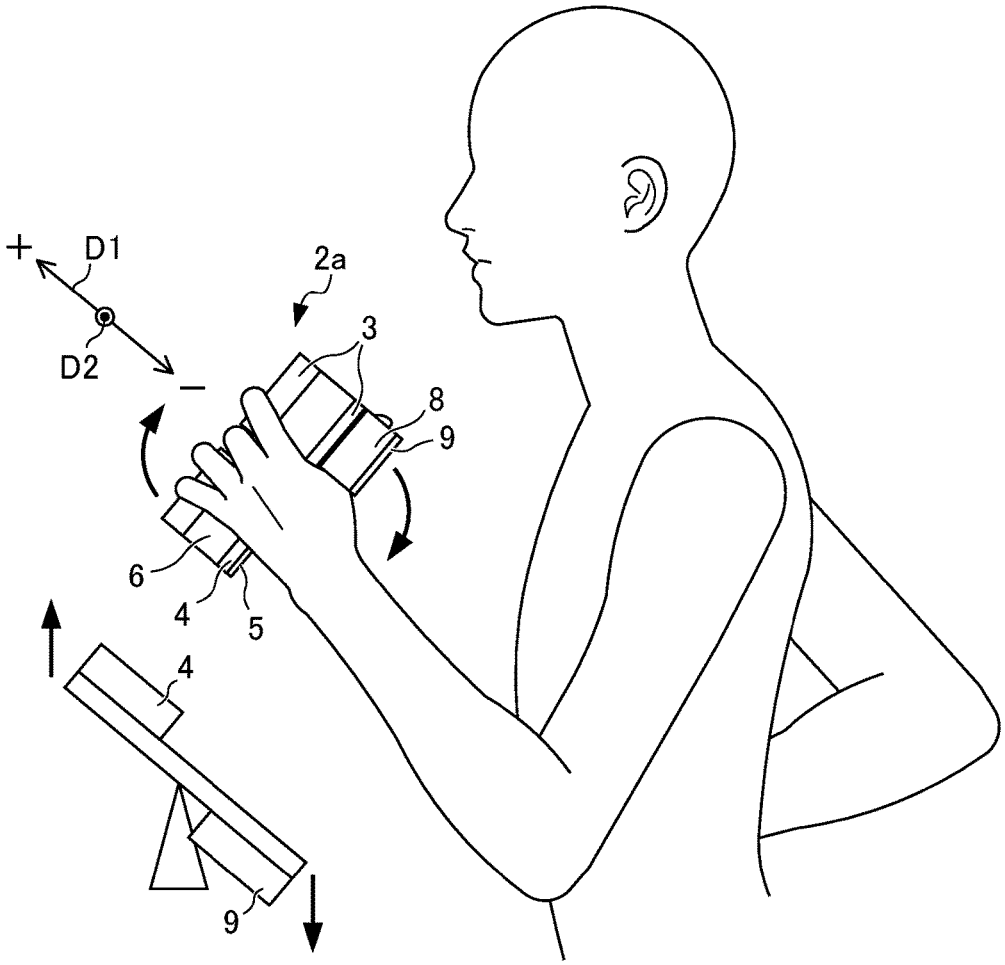
FIG. 13B is a view illustrating functions of the fourth weight member 9.
Figure 13C:
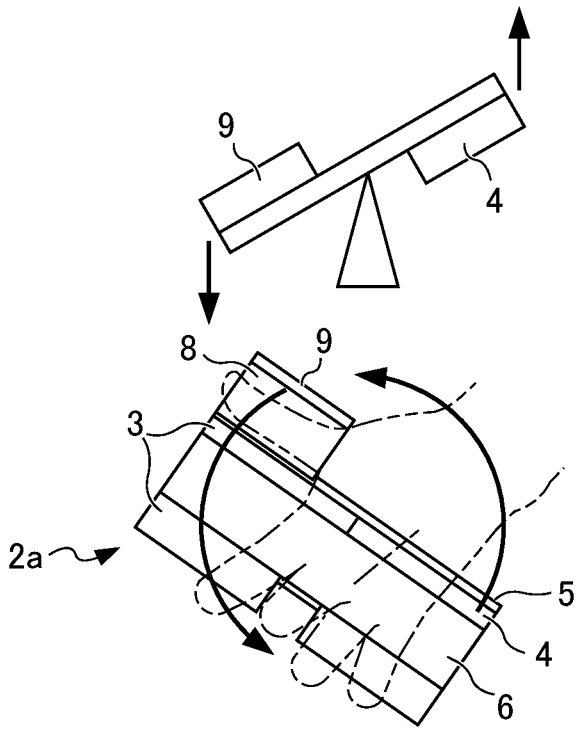
FIG. 13C is a view illustrating functions of the fourth weight member 9.

Next, an exercise assisting device 1A according to a second embodiment of the present invention will be explained. The points of the second embodiment that differ from the first embodiment will be explained. The explanation for the first embodiment can be invoked for points not explained in the second embodiment. FIG. 12 is a perspective view showing a left-hand grip body 2*a* of the exercise assisting device 1A according to the second embodiment of the present invention. FIGS. 13A to 13C are views illustrating the functions of a fourth weight member 9.

Compared to the exercise assisting device 1 of the first embodiment, the exercise assisting device 1A of the second embodiment differs from the exercise assisting device 1 of the first embodiment in the point of providing a holder 8 and fourth weight member 9, and the point of not providing the projecting member 7.

Compared to the configuration of the exercise assisting device 1 of the first embodiment, the exercise assisting device 1A of the second embodiment does not include the projecting member 7 (refer to FIG. 1), and further includes the thumb holder 8 as a holder and the fourth weight member 9, as shown in FIG. 12.

The thumb holder 8 is arranged on the rearward side (minus side) in the forward/rearward direction (first direction D1) of the gripping member 3, at an upper side of the gripping member 3, as shown in FIG. 12.

The thumb holder 8 covers the thumb in a state standing upwards. The thumb holder 8 is removable relative to the gripping member 3. The material of the thumb holder 8 is a raw material having safety so as not to injure the thumb.

The thumb holder 8 has a cross-section when viewed from an upper side that is a U shape, and extends in the longitudinal direction L. The open end of the U shape of the thumb holder 8 is mounted to a rear part of the gripping member 3. The thumb holder 8 covers the surface of the thumb on the opposite side to the second weight member 5 (rearward side (minus side) in forward/rearward direction (first direction D1) of gripping member 3) in a state gripping the grip body 2*a* by making the thumb in a state standing upwards contact with the second weight member 5, as shown in FIGS. 13A to 13C. The thumb holder 8 thereby has a function of not allowing the thumb to greatly depart from the gripping member 3 (second weight member 5 in present embodiment).

The fourth weight member 9 is mounted to an upper side of the gripping member 3 as shown in FIG. 12. The fourth weight member 9 is mounted over the entire range in the longitudinal direction L of the thumb holder 8, on the rearward side (minus side) in the forward/rearward direction (first direction D1) of the thumb holder 8. The fourth weight member 9 is a plate member parallel to the longitudinal direction L and second direction D2 (left/right direction). The fourth weight member 9 can be replaced with different weights.

The functions of the thumb holder 8 will be explained.

The thumb holder 8 is disposed on the rearward side (minus side) in the forward/rearward direction (first direction D1) of the gripping member 3, and covers the thumb in a state standing upwards. For this reason, as shown in FIGS. 13A to 13C, the thumb holder 8 does not allow the thumb to greatly depart from the gripping member 3 (second weight member 5 in present embodiment). The gripping of the gripping member 3 is thereby stabilized, and it is possible to greatly draw the elbow rearwards.

Next, the functions of the fourth weight member 9 will be explained.

The fourth weight member 9 is arranged on the rearward side (minus side) in the forward/rearward direction (first direction D1) of the thumb holder 8. For this reason, as shown in FIGS. 13A to 13C, the movement of rotating while accelerating to the upper side and the movement rotating while accelerating to the downward side are repeated about the joint of the thumb, as in a seesaw placing the first weight member 4 on one side and placing the fourth weight member 9 on the other side. It is thereby possible to easily swing the arms in the forward/rearward direction. For this reason, it is possible to hasten the speed of swinging in the forward/rearward direction of arms.

According to the exercise assisting device 1A of the second embodiment explained above, in addition to the effects of the above-mentioned exercise assisting device 1 of the first embodiment, the following such effects are exerted, for example.

The exercise assisting device 1A of the second embodiment further includes the thumb holder 8 which is disposed on the rearward side (minus side) in the forward/rearward direction (first direction D1) of the gripping member 3, as well as covering the thumb in a state standing upwards. For this reason, the thumb holder 8 does not allow the thumb to greatly depart from the side of the gripping member 3 (second weight member 5 in present embodiment). The gripping of the gripping member 3 thereby stabilizes, and it is possible to greatly draw the elbow rearwards.

In addition, in the present embodiment, the exercise assisting device 1A further includes the fourth weight member 9 disposed on the rearward side (minus side) in the forward/rearward direction (first direction D1) of the thumb holder 8. For this reason, the movement rotating while accelerating to the upper side and the movement rotating while accelerating to the downward side is repeated about the joint of the thumb. It is thereby possible to easily swing arms in the forward/rearward direction. As a result thereof, it is possible to hasten the speed of swinging in the forward/rearward direction of arms.

Although preferred embodiments of the present invention are explained above, the present invention is not to be limited to the aforementioned embodiments, and it is possible to realize in various forms.

For example, in the first embodiment, a configuration is explained in which all of the first weight member 4, second weight member 5, third weight member 6 and projecting member 7 are mounted to the gripping member 3. In the second embodiment, a configuration is explained in which all of the first weight member 4, second weight member 5, third weight member 6 and fourth weight member 9 are mounted to the gripping member 3. However, it is not limited thereto. For example, it may be a configuration in which at least any one of the first weight member 4, second weight member 5, third weight member 6, projecting member 7 and fourth weight member 9 are mounted to the gripping member 3.

In addition, in the present embodiment, the material of the gripping member 3 is preferably a light-weight raw material; however, it is not limited thereto. The material of the gripping member 3 is not limited to a light-weight raw material, and may be a heavy-weight material, e.g., metal or the like. The weights of the first weight member 4, second weight member 5, third weight member 6 and fourth weight member 9 are preferably greater than the weight of the entirety of the gripping member 3, respectively. It should be noted that the material of the gripping member 3 does not necessarily have the same specific gravity for the entirety, and the distribution of weight may be varied inside. If the material of the gripping member 3 is the same specific gravity, the specific gravity for each of the first weight member 4, second weight member 5, third weight member 6 and fourth weight member 9 is preferably greater than the specific gravity of the gripping member 3.

EXPLANATION OF REFERENCE NUMERALS

1 exercise assisting device
3 gripping member
4 first weight member
5 second weight member
6 third weight member
7 projecting member (protrusion)
8 thumb holder (holder)
9 fourth weight member
31 recess groove (recessed part)

The invention claimed is:

1. An exercise assisting device comprising:
a gripping member extending in a tubular shape or columnar shape that can be gripped by hand, and
a first plate-shaped weight member, and
a second plate-shaped weight member;
wherein the gripping member has a recessed part in which only a portion at which a middle finger is disposed upon gripping by hand is recessed,
wherein forward of the gripping member corresponds to forward of a person, and rearward of the gripping member corresponds to rearward of the person, when gripping the gripping member forward of the person in a state making the gripping member stand up,
wherein a first flat surface having a first weight mounting part is disposed at a lower part on a rearward side of the gripping member and the first plate-shaped weight member is configured to attach to the first weight mounting part, and
wherein a second flat surface having a second weight mounting part is disposed on the rearward side of the gripping member, and the second plate-shaped weight member is configured to attach to the second weight mounting part so that the second plate-shaped weight member extends in a longitudinal direction of the gripping member.

2. The exercise assisting device according to claim 1 further comprising a third plate-shaped weight member,
wherein a third weight mounting part of a flat surface is disposed at a lateral part on either outward side of the gripping member, and the third plate-shaped weight member is configured to attach to the third weight mounting part so that the third plate-shaped weight member extends in the longitudinal direction of the gripping member.

3. The exercise assisting device according to claim 1 further comprising a protrusion,
wherein the protrusion is disposed at a circumferentially partial area of a circumferential surface of the gripping member and configured to be removable relative to the gripping member, and
wherein the protrusion is disposed between a ring finger and a pinky finger when gripping the gripping member.

4. The exercise assisting device according to claim 2 further comprising a holder which is configured to have a substantially U-shaped section when viewed in the longitudinal direction of the gripping member,
wherein the holder is disposed on a rearward side of the gripping member and configured to cover a thumb in a state standing upwards along the longitudinal direction of the gripping member.

5. The exercise assisting device according to claim 4, further comprising a fourth weight member disposed on a rearward side of the holder.

6. An exercise assisting device comprising:
a gripping member extending in a tubular shape or columnar shape that can be gripped by hand, and
a plate-shaped weight member, and
a second plate-shaped weight member;
wherein the gripping member has a recessed part in which only a portion at which a middle finger is disposed upon gripping by hand is recessed,
wherein forward of the gripping member corresponds to forward of a person, and rearward of the gripping member corresponds to rearward of the person, when gripping the gripping member forward of the person in a state making the gripping member stand up,
wherein a first flat surface having a weight mounting part is disposed on a rearward side of the gripping member, and the plate-shaped weight member is configured to attach to the weight mounting part so that the plate-shaped weight member extends in a longitudinal direction of the gripping member, and
wherein a second flat surface having a second weight mounting part is disposed on the rearward side of the gripping member, and the second plate-shaped weight member is configured to attach to the second weight mounting part so that the second plate-shaped weight member extends in a longitudinal direction of the gripping member.

7. The exercise assisting device according to claim 6 further comprising a third plate-shaped weight member, wherein a third weight mounting part of a flat surface is disposed at a lateral part on either outward side of the gripping member, and the third plate-shaped weight member is configured to attach to the third weight mounting part so that the third plate-shaped weight member extends in a longitudinal direction of the gripping member.

8. The exercise assisting device according to claim 6 further comprising a protrusion, wherein the protrusion is disposed at a circumferentially partial area of a circumferential surface of the gripping member and configured to be removable relative to the gripping member, and wherein the protrusion is disposed between a ring finger and a pinky finger when gripping the gripping member.

9. An exercise assisting device comprising:

a gripping member extending in a tubular shape or columnar shape that can be gripped by hand, a plate-shaped weight member, and a second plate-shaped weight member;

wherein the gripping member has a recessed part in which only a portion at which a middle finger is disposed upon gripping by hand is recessed, wherein forward of the gripping member corresponds to forward of a person, rearward of the gripping member corresponds to rearward of the person, and outwards of the gripping member corresponds to either outward in a left/right direction of the person, when gripping the gripping member forward of the person in a state making the gripping member stand up, wherein a first flat surface having a weight mounting part is disposed at a lateral part on either outward side of the gripping member, and the plate-shaped weight member is configured to attach to the weight mounting part so that the plate-shaped weight member extends in a longitudinal direction of the gripping member, and wherein a second flat surface having a second weight mounting part is disposed on a rearward side of the gripping member, and the second plate-shaped weight member is configured to attach to the second weight mounting part so that the second plate-shaped weight member extends in a longitudinal direction of the gripping member.

10. The exercise assisting device according to claim 9 further comprising a protrusion, wherein the protrusion is disposed at a circumferentially partial area of a circumferential surface of the gripping member and configured to be removable relative to the gripping member, and wherein the protrusion is disposed between a ring finger and a pinky finger when gripping the gripping member.

* * * * *